United States Patent [19]

Iwamori et al.

[11] Patent Number: 4,746,275

[45] Date of Patent: May 24, 1988

[54] MULTI-PISTON SWASH PLATE TYPE COMPRESSOR WITH INTERNAL LUBRICATING ARRANGEMENT

[75] Inventors: Hidekazu Iwamori; Makoto Ohno; Hideo Mori; Shinji Mizuno, all of Kariya, Japan

[73] Assignee: Kabushiki Kaisha Toyoda Jidoshokki Seisakusho, Aichi, Japan

[21] Appl. No.: 944,936

[22] Filed: Dec. 22, 1986

[30] Foreign Application Priority Data

Dec. 25, 1985 [JP] Japan ..... 60-295998

[51] Int. Cl.[4] ..... F04B 1/16; F04B 1.18

[52] U.S. Cl. ..... 417/269; 184/6.17

[58] Field of Search ..... 417/269; 184/6.17; 92/71

[56] References Cited

U.S. PATENT DOCUMENTS

| | | | |
|---|---|---|---|
| 3,904,320 | 9/1975 | Kishi | 417/269 |
| 3,930,758 | 1/1976 | Park | 417/269 |
| 3,999,893 | 12/1976 | Kishi | 417/269 |
| 4,229,145 | 10/1980 | Isizuka | 417/269 |
| 4,285,640 | 8/1981 | Mukai | 417/269 |
| 4,381,178 | 4/1983 | Nakayama | 417/269 |
| 4,413,954 | 11/1983 | Okazaki | 417/269 |
| 4,596,518 | 6/1986 | Sumikawa | 417/269 |
| 4,621,570 | 2/1987 | Futamura | 417/269 |

FOREIGN PATENT DOCUMENTS

| | | | |
|---|---|---|---|
| 159711 | 12/1979 | Japan | 417/269 |
| 48002 | 2/1980 | Japan | 417/269 |

*Primary Examiner*—William L. Freeh

*Attorney, Agent, or Firm*—Burgess, Ryan & Wayne

[57] ABSTRACT

A multi-piston swash plate type compressor with an internal lubricating arrangement for an air conditioning system used in a vehicle such as an automobile comprises a cylinder block body having a swash plate chamber formed therein for receiving a swash plate, and cylinder bores formed therein for receiving pistons. The compressor has a suction chamber which is fed with a refrigerant including a lubrication oil from an evaporator of the air conditioning system, and a discharge chamber which feeds the compressed refrigerant to a condenser of the air conditioning system. The suction and discharge chambers are communicated with each of the cylinder bores through valves. Passages are formed in the cylinder block body for feeding the refrigerant from the swash plate member to the suction chamber in such a manner that the refrigerant flow is guided to positively lubricate movable parts included in the cylinder block body as a component element of the compressor.

6 Claims, 3 Drawing Sheets

MULTI-PISTON SWASH PLATE TYPE COMPRESSOR WITH INTERNAL LUBRICATING ARRANGEMENT

BACKGROUND OF THE INVENTION (1) Field of the Invention

The present invention relates to a compressor for an air-conditioning system used in a vehicle such as an automobile, and more particularly, to a multi-piston swash plate type compressor with an internal lubricating arrangement for lubricating internal movable parts therein.

(2) Description of the Related Art

U.S. Pat. No. 4,403,921 discloses a multi-piston swash plate type compressor having such an internal lubricating arrangement, comprising: a cylinder block body assembled from a pair of cylinder block halves to form a swash plate chamber therebetween, the cylinder block halves having a same number of cylinder bores which are concentrically formed with respect to the central axis of the cylinder block body, the cylinder bores of one cylinder block half being aligned and registered with the cylinder bores of the other cylinder block half, respectively, with the swash plate chamber intervening therebetween; common piston members slidably received in the pairs of aligned cylinder bores, respectively; a swash plate member disposed within the swash plate chamber to be slidably engaged with the common piston members so that the pistons are reciprocated in the pairs of aligned cylinder bores, respectively, by rotation of the swash plate member; a shaft member which extends into an axial bore of the cylinder block body so that it passes through the swash plate chamber and on which the swash plate member is fixedly mounted; a pair of radial bearings provided within the axial bore sections in the cylinder block halves, respectively, for rotatably supporting the shaft member in the axial bore of the cylinder block body; a pair of thrust bearings provided around the shaft member at the sides of the swash plate member; a pair of dish-like housing members mounted on the end faces of the cylinder block body, respectively, so as to form a suction chamber and a discharge chamber between each of the dish-like housing members and the corresponding end face of the cylinder block body; and a disc-like reed valve assembly disposed between each of the dish-like housing members and the corresponding end face of the cylinder block body so that each of the cylinder bores is communicated with the corresponding suction and discharge chambers through the intermediary of the corresponding suction and discharge reed valve elements of the disc-like reed valve assembly.

In the compressor as mentioned above, the cylinder block halves, the dish-like housing members, and the disc-like reed valve assemblies are assembled as a unit by elongated screws extended into screw bores formed in these compressor components in the vicinity of the periphery thereof, the screw bores being in communication with the swash plate chamber and the suction chambers. The swash plate chamber is adapted to be fed with a refrigerant including a lubricating oil from an evaporator of an air conditioning system. The refrigerant including a lubricating oil is then fed from the swash plate chamber to the suction chambers through the screw bores.

In this conventional arrangement, it is intended that the movable parts are lubricated by the lubricating oil included in the refrigerant by introducing it into the swash plate chamber. In particular, since there are sliding surfaces between the swash plate member and the piston members within the swash plate chamber, they are lubricated by introducing the refrigerant including a lubricating oil into the swash plate chamber. Also, the thrust bearings are disposed within the swash plate chamber at the sides of the swash plate member so that they too are lubricated by the lubricating oil included in the refrigerant. Furthermore, since the axial bore sections of the cylinder block halves in which the radial bearings are disposed are in communication with the swash plate chamber, the refrigerant including a lubricating oil can obtain access to the radial bearings for lubrication thereof.

However, with the conventional internal lubricating arrangement as mentioned, a large part of the refrigerant including a lubricating oil introduced to the swash plate chamber is directly fed to the suction chambers through the screw bores of the cylinder block halves without sufficient circulation of the refrigerant within the swash plate chamber, so that it is impossible to obtain sufficient lubrication of the movable parts of the compressor. For this reason, during a high speed run of the compressor, a seizure of the movable parts may occur.

U.S. Pat. No. 4,381,178 also discloses a multi-piston swash plate type compressor wherein the internal lubricating arrangement is improved in comparison to that of the above-mentioned U.S. Pat. No. '921. According to this internal lubricating arrangement, not only is the refrigerant including a lubricating oil fed from the swash plate chamber to the suction chamber, but also the axial bore sections in the cylinder block halves are in communication with the suction chamber so that a part of the refrigerant from the swash plate chamber is fed thereto. In other words, it is intended that the refrigerant including a lubricating oil flows through clearances among the component elements of the thrust and radial bearings by communicating the swash plate chamber with the suction chambers, so that an effective lubrication of the thrust and radial bearings can be achieved. However, U.S. Pat. No. 4,381,178 fails to carry out an effective lubrication of the thrust and radial bearings because a large part of the refrigerant has a tendency to flow from the swash plate chamber to the suction chambers through the screw bores because of the high flow resistance of the axial bore sections in the cylinder block halves. In short, although this internal lubricating arrangement is an improvement in comparison to that of the first-mentioned US patent, a seizure at the movable parts of the compressor still may occur during a high speed run thereof.

SUMMARY OF THE INVENTION

Accordingly, it is an object of the present invention to provide an improved multi-piston swash plate type compressor with an internal lubricating arrangement, which is so constructed that the movable parts thereof can be sufficiently and positively lubricated by the lubricating oil included in the refrigerant.

It is an additional object of the present invention to provide a multi-piston swash plate type compressor with an internal lubricating arrangement, wherein an area of the cylinder block body in contact with the refrigerant is increased so that a cooling effect on the cylinder bores and the piston members is enhanced, whereby a seizure therebetween can be substantially avoided.

In accordance with the present invention, there is provided a multi-piston swash plate type compressor with an internal lubricating arrangement for an air conditioning system used in a vehicle such as an automobile which comprises, in combination:

a cylinder block means in which a swash plate chamber is formed for receiving a swash plate member therein, and which has cylinder bores concentrically formed with respect to the central axis of the cylinder block body, each of the cylinder bores receiving a piston member so as to be slidably engaged with the swash plate member to reciprocate the piston member in the corresponding cylinder bore by rotation of the swash plate member, the swash plate chamber being adapted to be fed with a refrigerant including a lubrication oil from an evaporator of the air conditioning system, the swash plate member being fixedly mounted on a shaft member which extends into the swash plate chamber through an axial bore formed in the cylinder block means, and which is adapted to be connected to a prime motor of the vehicle for the rotation of the swash plate;

housing means provided on the cylinder block means for forming a suction chamber which is communicated with the cylinder bores through the intermediary of a valve element and a discharge chamber which is communicated with the cylinder bores through the intermediary of a valve element, the suction chamber being in communication with the swash plate chamber through the axial bore of the cylinder block means, the discharge chamber being adapted to be connected to a condenser of the air conditioning system for feeding compressed refrigerant thereto; and passage means provided in said cylinder block means for feeding the refrigerant including a lubricating oil from the swash plate chamber to the suction chamber in such a manner that the refrigerant flow is guided to positively lubricate movable parts included in the cylinder block as a component element of the compressor.

According to the present invention, there is also provided a multi-piston swash plate type compressor with an internal lubrication arrangement for an air conditioning system used in a vehicle such as an automobile, which comprises:

a cylinder block body which is assembled from a pair of cylinder block halves to form a swash plate chamber therebetween, the cylinder block halves having a same number of cylinder bores which are concentrically formed with respect to the central axis of the cylinder block body, and the cylinder bores of one cylinder block half being aligned and registered with the cylinder bores of the other cylinder block half, respectively, with the swash plate chamber intervening therebetween;

common piston members slidably received in the pairs of aligned cylinder bores, respectively;

a swash plate member which is disposed within the swash plate chamber to be slidably engaged with the common piston members so that they are reciprocated in the pairs of aligned cylinder bores, respectively, by rotation of the swash plate member;

a shaft member which extends into an axial bore of the cylinder block body so that it passes through the swash plate chamber and on which the swash plate member is fixedly mounted;

a pair of dish-like housing members which are mounted on the end faces of the cylinder block body, respectively, so as to form a suction chamber and a discharge chamber between each of the dish-like housing members and the corresponding end face of the cylinder block body;

a disc-like reed valve assembly which is disposed between each of the dish-like housing members and the corresponding end face of the cylinder block body so that each of the cylinder bores is communicated with the corresponding suction and discharge chambers through the intermediary of the corresponding suction and discharge reed valve elements of the disc-like reed valve assembly; and passage means provided in the cylinder block body for feeding the refrigerant including a lubricating oil from the swash plate chamber to the suction chamber in such a manner that the refrigerant flow is guided to positively lubricate movable parts included in the cylinder block body as a component element of the compressor.

In the present invention, the movable parts may include a pair of thrust bearings which are provided around the shaft member at the sides of the swash plate member, and a pair of radial bearings which are provided within the axial bore sections in the cylinder block halves, respectively, for rotatably supporting the shaft member in the axial bore of the cylinder block body.

Preferably, each of the common piston members has a slot for receiving a peripheral portion of the swash plate member, and the swash plate member is engaged with each of the piston members through the intermediary of a pair of shoe elements in such a manner that the shoe elements are slidably disposed between the opposed wall faces of the slot and the opposed side faces of the peripheral portion, respectively. In this case, the shoe elements may be included in the movable parts. More preferably, the shoe elements are formed as a semi-spherical element, the spherical surface thereof being in slidable contact with a complemental recess formed on the corresponding wall surface of the slot of the piston member and the other circular flat surface thereof being in slidable contact with the corresponding side face of the peripheral portion of the swash plate member.

In the present invention, preferably, the passage means includes a through passage which is formed in each of the cylinder block halves, one port of the through passage opening into the corresponding suction chamber and the other port thereof opening into the swash plate chamber in the vicinity of the corresponding thrust bearing, whereby the refrigerant flow is radially and inwardly directed to the thrust bearings. The passage means further includes a branch passage which extends from the through passage to open into the axial bore section of the corresponding cylinder block half, whereby the refrigerant flow is directed to the radial bearing disposed in the axial bore.

The passage means may include additional grooves which are radially formed on the wall surfaces of said cylinder block halves forming the swash plate chamber to guide the refrigerant flow toward each of the other ports of the through passage.

In the present invention, each of the suction chambers may be inwardly or outwardly disposed in the corresponding dish-like housing member with respect to the discharge chamber.

BRIEF DESCRIPTION OF THE DRAWINGS

These and other objects of the present invention will be better understood from the following description, with reference to the accompanying drawings, in which.

DESCRIPTION OF THE PREFERRED EMBODIMENTS

Figure 1:
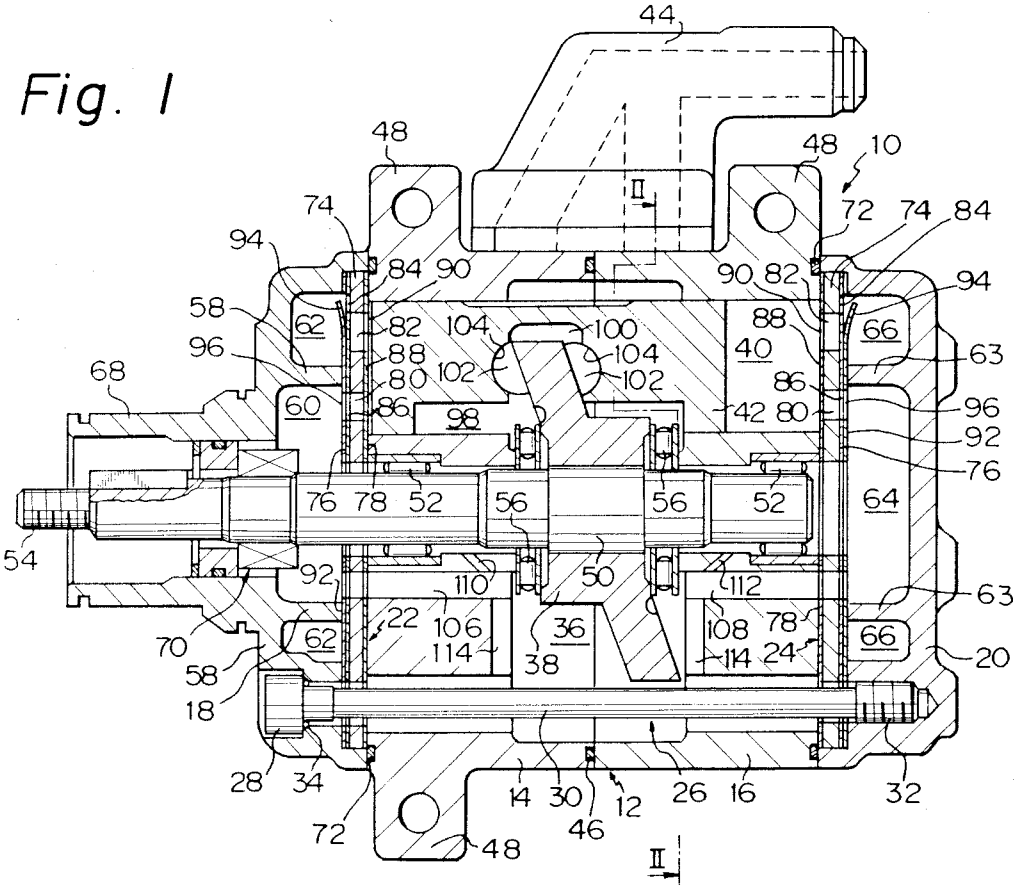
FIG. 1 is a longitudinal sectional view of a multi-piston swash plate type compressor constructed according to the present invention.

With reference to FIG. 1, a multi-piston swash plate type compressor according to this invention, generally designated by reference numeral 10, comprises a cylinder block body 12 assembled as a unit by a pair of cylinder block halves 14 and 16, dish-like housing members 18 and 20 mounted on the end faces of the assembled cylinder block body 12, respectively, and disc-like valve assemblies 22 and 24 disposed between the dish-like housing members 18 and 20 and the respective end faces of the cylinder block body 12.

Figure 2:
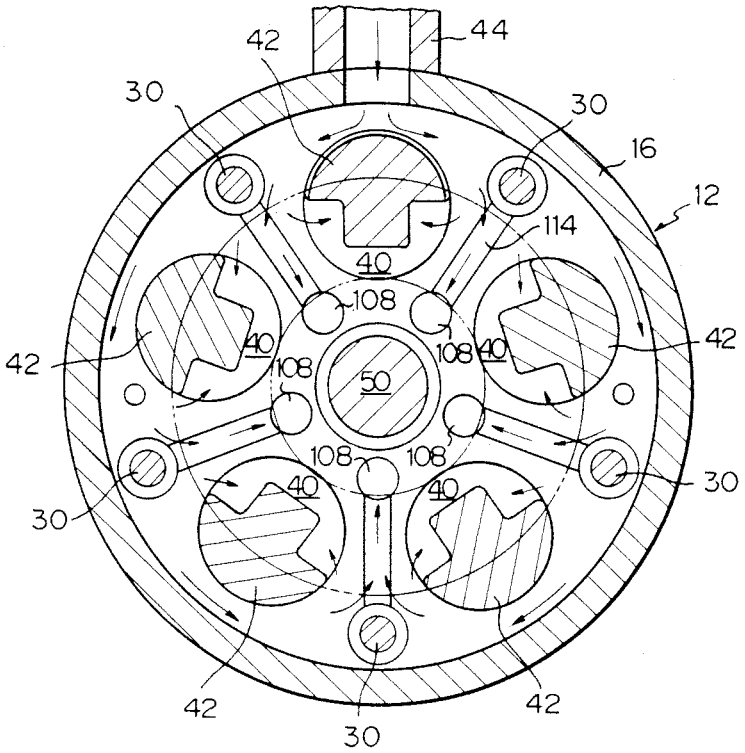
FIG. 2 is a cross-sectional view taken along the line II—II of FIG. 1.

As can be seen from FIGS. 1 and 2, in this embodiment, all of the parts mentioned above are assembled together by five elongated screws 26 which extend from the dish-like housing member 18 into the dish-like member 20 through the disk-like valve assembly 22, the assembled cylinder block body 12, and the dish-like housing member 24. As represented in FIG. 1, the elongated screw 26 has a head portion 28, a shank portion 30, and a threaded end portion 32, with the shank portion 30 extending through aligned bores formed in succession in the housing member 18, the valve assembly 22, the block body 12, and the valve assembly 24; the head portion 28 being sealingly engaged with the bore end rim of the housing member 18 through the intermediary of an O-seal ring 34, and the threaded end portion 32 being threaded into a thread bore formed in the housing member 20.

The cylinder block halves 14 and 16 have a cylindrical recess formed at their opposed inner side faces, and when assembled as a unit to form the cylinder block body 12, both the cylindrical recesses thereof form a swash plate chamber 36 in which a swash plate member 38 is disposed. In this embodiment, each of the cylinder lock halves 14 and 16 has five cylinder bores 40 formed circumferentially therein, which are spaced from each other at regular intervals. In FIG. 2, only an arrangement of five cylinder bores 40 of the cylinder block half 16 is shown, but this is the same for the five cylinder bores of the cylinder block 14. The five cylinder bores 40 of the block half 16 are registered and aligned with those of the block half 14, respectively, and each pair of the registered and aligned bores 40 of the block halves 14 and 16 slidably receives a common piston member 42 which is engaged with the swash plate 38 member in a manner as mentioned hereinafter.

The cylinder block body 12 is provided with an intake pipe member 44 mounted thereon, which is adapted to be connected to an evaporator of an air conditioning system to introduce a refrigerant including a lubricating oil into the swash plate chamber 36. As can be seen from FIG. 1, the intake pipe member 44 has an intake passage, shown by broken lines, which is divided into two branch passages opening into the swash plate chamber 36 so that movable parts included in the cylinder block halves 14 and 16 are uniformly lubricated by the introduced refrigerant including a lubricating oil. The cylinder block body is also provided with an annular seal element 46 disposed between the cylinder block halves 14 and 16, for preventing the refrigerant from leaking through the annular faces thereof. Furthermore, the cylinder block body 16 is provided with fitting elements 48 formed integrally therewith, which are used to attach the compressor, as a part of the air conditioning system, to a suitable mount of a vehicle such as an automobile.

The cylinder block halves 14 and 16 have a central axial bore formed therein for receiving a shaft member 50 which is rotatably supported by a pair of radial bearings 52, 52 provided in the central axial bores of the block halves 14 and 16, respectively. The swash plate 38 is fixedly mounted on the shaft member 50 within the swash plate chamber 36. As shown in FIG. 1, the shaft member 50 has an end portion which is supported by the bearing 52 provided in the axial bore of the block half 16, whereas the other end portion of the shaft member 50 terminates in a threaded end 54 of a portion thereof which extends through the central axial bore of the block half 14, the disc-like valve assembly 22, and the dish-like housing member 18. The threaded end 54 is adapted to be coupled to a prime motor of the vehicle for rotation of the swash plate member 38. As well known, since the swash plate member 38 is subjected to a thrust force during a rotational operation thereof, a pair of thrust bearings 56, 56 are provided around the shaft member 50 and are disposed between the opposed sides of a central portion of the swash plate member 38 and the opposite inner sides of the block halves 14 and 16, respectively.

The dish-like housing member 18 is provided with an annular partition wall 58 which is arranged therein so as to define an inner suction chamber 60 and an outer annular discharge chamber 62. In particular, the inner suction chamber 60 is formed around the shaft member 50, and then the outer annular discharge chamber 62 surrounds the inner suction chamber 60. On the other hand, the dish-like housing member 20 is also provided with an annular partition wall 63 which is arranged therein so as to define an inner circular suction chamber and a surrounding outer annular discharge chamber 66. In addition, the dish-like housing 18 has a sleeve member 68 formed integrally therewith, which partially surrounds the shaft member 50, as shown in FIG. 1, and in which a well known seal assembly 70 is provided to seal the suction chamber 60 from outside so that the refrigerant is prevented from leaking from the suction chamber 60 through an annular gap between the shaft member 50 and the sleeve member 68.

As shown in FIG. 1, an annular seal element 72 is disposed between each of the dish-like housing members 18 and 20 and the corresponding end face of the cylinder block body 12, so as to ensure a sealing therebetween.

The disc-like valve assemblies 22 and 24 per se are well known in this field and may be identical with each other in the illustrated embodiment. Each of the valve assemblies 22 and 24 includes an annular valve plate 74 and a pair of annular valve discs 76 and 78, which are attached to the side faces thereof, respectively, and which are made of a thin metal material such as a stainless steel.

The annular valve plate 74 has five suction ports 80 and discharge ports 82 formed therein, both of which are concentrically disposed with respect to the center of the valve plate 74 and which are spaced apart from each other at regular intervals, one of the suction ports 80 being radially aligned with the corresponding one of the discharge ports 82 and the aligned suction and discharge ports 80 and 82 being included in the cross-sectional area of the corresponding cylinder bore 40. Also, all of the suction ports 80 are included in the cross-sectional area of the suction chamber 60, 64, whereas all of the discharge ports 82 are included in the cross-sectional area of the discharge chamber 62, 66.

The annular valve disc 76 has five reed valve elements 84 which are preferably formed therein by stamping. The reed valve elements 84 are concentrically disposed with respect to the center of the valve disc 76 so that each of the reed valve elements 84 is registered with the corresponding one of the discharge ports 82. The valve disc 76 also has five opening ports 86 formed therein, which are concentrically disposed with respect to the center of the valve disc 76 so that each of the opening ports 86 is registered with the corresponding one of the suction ports 80.

On the other hand, the annular valve disc 78 also has five reed valve elements 88 formed therein by stamping. The reed valve elements 88 are concentrically disposed with respect to the center of the valve disc 78 so that each of the reed valve elements 88 is registered with the corresponding one of the suction ports 88. Similarly, the valve disc 78 has five opening ports 90 which are concentrically disposed with respect to the center of the valve disc 78 so that each of the opening ports 90 is registered with the corresponding one of the discharge ports 82.

The disc-like valve assembles 22 and 24 further include an annular valve retainer disc 92 having five valve retainer elements 94 which are concentrically disposed with respect to the center of the retainer disc 92 so that each of valve retainer elements 94 are registered with the corresponding one of the discharge reed valves 84. The valve retainer disc 92 also has five opening ports 96 which are concentrically disposed with the center of the retainer disc 92 so that each of the opening ports 96 is registered with the corresponding suction port 80 and the opening ports 86 of the valve disc 76. The valve assemblies 22 and 24 may include an annular valve retainer disc (not shown) for the suction valve elements 88, if necessary.

With the arrangement mentioned above, each of the suction chambers 60 and 64 is in communication with the swash plate chamber 36 through the axial bore of the cylinder block half 14, 16 and the central opening of the disc-like valve asembly 22, 24. More concretely, the suction chambers 60, 64 are communicated with the swash plate chamber through the intermediary of clearances among the component elements of the corresponding thrust and radial bearings 56 and 52. Also, the suction chambers 60, 64 and the discharge chambers 62, 66 are in communication with the corresponding suction and discharge reed valve elements 88 and 84, respectively. In addition, the discharge chambers 62 and 66 are adapted to be communicated with a condenser of the air conditioning system by use of a suitable coupling (not shown) for feeding the compressed refrigerant thereto.

As can be seen from FIGS. 1 and 2, the piston members 42 include a recess 98 formed in the side thereof which is directed to the shaft member 50. The recess 98 serves to prevent the piston member 42 from interference from the periphery of the thrust bearings 56 during the receiprocation thereof. The piston members 42 further include a slot 100 which is formed at the center of the recess 98 for receiving the peripheral portion of the swash plate member 38. As shown in FIG. 1, a pair of semi-spherical shoe elements 102 are provided between the opposed sides of the peripheral portion of the swash plate member 38 and the opposite side walls of the slot 100, respectively. The opposite side walls of the slot 100 have a spherical recess 104 formed therein, which has a complemental relationship with the spherical surface of each shoe element 102. The spherical surface of each shoe element 102 is in slidable contact with the corresponding spherical recess 104 and the circular flat surface thereof is in slidable contact with the corresponding side face of the peripheral portion of the swash plate member 38, whereby each piston member 42 is reciprocated in the corresponding aligned cylinder bores 40 of the cylinder block halves 14 and 16 by the rotation of the swash plate member 38.

Into the compressor 10, illustrated in FIGS. 1 and 2, is incorporated a passage means, which is a feature of the present invention, for feeding the refrigerant including a lubricating oil from the swash plate chamber 36 into the suction chambers 60 and 64. The passage means includes through passages 106 and 108 formed in the cylinder block halves 14 and 16, respectively. As apparent from FIGS. 1 and 2, in this embodiment, five through passages 106, 108 are formed in each of the cylinder block halves 14 and 16, which are concentrically disposed with respect to the central axis thereof in the vicinity of the shaft member 50 and substantialy parallel therewith, and which are spaced apart from each other at regular intervals, one port of the through passages 106, 108 opening into the corresponding suction chamber 60, 64 and the other port thereof opening into the swash plate chamber 36 in the vicinity of the corresponding thrust bearing 56. The passage means also includes branch passages 110 which extend from the through passages 106, respectively, so as to open into the axial bore of the cylinder block half 14, and branch passages 112 which extend from the through passages 108, respectively, so as to open into the axial bore of the cylinder block half 16. Preferably, the passage means further includes grooves 114 which are radially formed in the opposite wall surfaces (forming the swash plate chamber 36) of the cylinder block halves 14 and 16 so that each of the grooves 114 is led to the corresponding one of the through passages 106, 108.

In operation, rotation of the swash plate member 38 causes each of the piston members 42 to be reciprocated in the corresponding pair of aligned cylinder bores 40 so that one of the aligned cylinder bores 40 is subjected to a compression stroke while the other bore is subjected to a suction stroke. Each of the cylinder bores 40 subjected to the suction stroke sucks in the refrigerant including a lubricating oil from the swash plate chamber 36 through the corresponding suction port 80 and the reed valve element 88 associated therewith. On the other hand, each of the cylinder bores 40 subjected to the compression stroke discharges the compressed refrigerant including a lubricating oil into the discharge chamber through the corresponding discharge port 82 and the reed valve element 84 associated therewith.

The compressed refrigerant is fed to the condenser of the air conditioning system and is then returned to the compressor 10 through the evaporator thereof. The returned refrigerant is introduced into the swash plate chamber 36 through the intake pipe member 44 and then flows from the periphery of the swash plate chamber 36 toward the center thereof, that is, the shaft member 50, as indicated by arrows in FIG. 2, because of the arrangement of the through passages 106 and 108 in the vicinity of the shaft member 50.

As mentioned above, the refrigerant including a lubricating oil introduced into the swash plate 36 through the intake pipe member 44 has a tendency to flow toward the center of the swash plate chamber 36, whereby the movable parts of the compressor 10, including the thrust bearings 56, the radial bearings 52, and the semi-spherical shoe elements 102, are sufficiently lubricated by the lubricating oil included in the refrigerant. Also, it can be easily understood that due to the disposition of the other port of the through passages 106, 108 in the vicinity of the corresponding thrust bearing 56, and due to the existence of the branch passages 110 opening into the axial bores of the cylinder block halves 4 and 6, the radial bearings 52 and the thrust bearings 56 are positively lubricated by the lubricating oil included in the refrigerant. Furthermore, the provision of the grooves 114 serves to positively direct the refrigrant including a lubrication oil to the through passages 106, 108, whereby a positive lubrication of the radial and thrust bearings can be further ensured.

Figure 3:
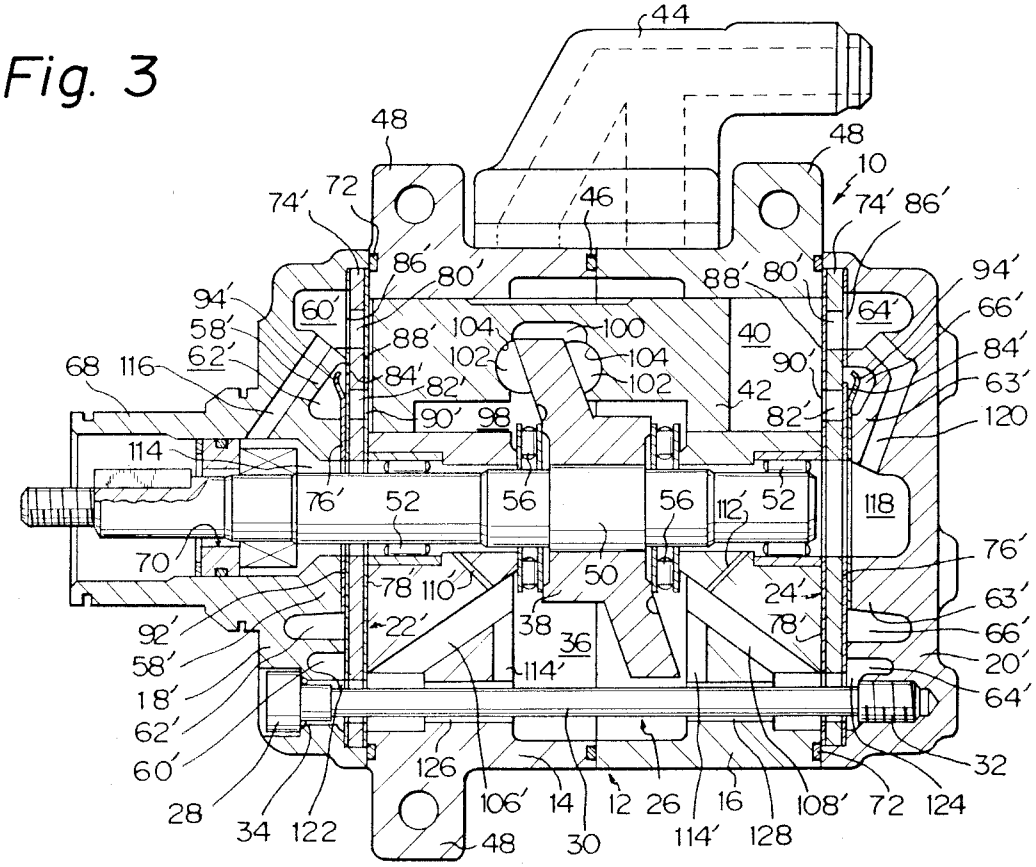
FIG. 3 is a longitudinal sectional view of another embodiment of the present invention.

Another embodiment of the present invention is shown in FIG. 3, which is similar to FIG. 1. In FIG. 3, the elements similar to those of FIG. 1 are indicated by the same reference numerals whereas the elements corresponding to those of FIG. 1 are indicated by the same reference numerals plus a prime.

In this second embodiment, a dish-like housing member 18' includes an annular partition wall 58' in which an annular discharge chamber 62' is formed. The partition wall 58' forms an annular suction chamber 60' surrounding the discharge chamber 58' and an additional chamber 114' surrounding the shaft 50, both chambers 60' and 114' being in communication with a passage 116 formed in the partition wall 58'. Accordingly, as in the first embodiment of FIGS. 1 and 2, the suction chamber 60' is in communication with the swash plate chamber 36. On the other hand, a dish-like housing member 20' also includes an annular partition wall 63' in which an annular discharge chamber 66' is formed. Similarly, the partition wall 63' forms an annular suction chamber 64' surrounding the discharge chamber 66' and an additional chamber 118 surrounding the shaft 50, both chambers 64' and 118 being in communication with a passage 120 formed in the partition wall 63'. Accordingly, the suction chamber 64' also is in communication with the swash plate chamber 36.

Disc-like valve assemblies 22' and 24' are substatially identical with the disc-like valve assemblies 22 and 24 except that suction ports 80' of an annular valve plate 74' are outwardly disposed with respect to discharge ports 82', and that valve discs 76' and 78' and a valve retainer disc 92' are constructed in accordance with the arrangement of the outer suction ports 80' and the inner discharge ports 82'.

As one feature of the second embodiment, it should be noted that the suction chambers 60' and 64' also are in communication with the swash plate chamber 36 through the bores for the screws 26, these bores opening into the suction chambers 60' and 64' at 122 and 124, respectively, but the bores are substantially restricted at the bore sections 126 and 128 formed in the cylinder block halves 14 and 16. Another feature of the second embodiment resides in a passage means for feeding the refrigerant including a lubricating oil from the swash plate chamber 36 to the suction chambers 60' and 64'. In particular, the passage means includes five through passages 106' and 108' formed in the cylinder block halves 14 and 16, respectively. The five through passages 106', 108' are concentrically disposed with respect to the center axis of the corresponding cylinder block half 14', 16' as in the first embodiment. However, one port of the through passages 106', 108' opens into the corresponding one of the bores for the screws 26, so that the through passages 106', 108' are in communication with the corresponding suction chamber 60', 64', whereas the other port thereof opens into the swash plate chamber 36 in the vicinity of the corresponding thrust bearing 56, as in the first embodiment. The passage means also includes branch passages 110' which extend from the through passages 106', respectively, so as to open into the axial bore of the cylinder block half 14, and branch passages 112' which extend from the through passages 108', respectively, so as to open into the axial bore of the cylinder block half 16.

In the operation of the second embodiment, it can be easily understood that the movable parts including the semi-spherical shoe elements, the radial bearings, and the thrust bearings are positively and sufficiently lubricated by the lubricating oil included in the refrigerant because of the restriction of the bores for the screws 26 and because of the arrangement of the through and branch passages provided in the cylinder block halves 14 and 16.

As apparent from the foregoing, in the multi-piston swash plate type compressor having the internal lubricating arrangement according to the present invention, since the movable parts thereof are positively and sufficiently lubricated by the lubricating oil included in the refrigerant, they can be prevented from seizure during a high speed run of the compressor. In addition, according to the present invention, the cylinder block body has an increased area in contact with the refrigerant due to the provision of the through and branch passages therein, so that a cooling effect of the cylinder block body is enhanced and thus seizure resistance of the piston members can be avoided.

Although the multi-piston swash plate type compressor according to the first and second embodiments includes the cylinder block body in which the cylinder bores are disposed at the sides of the swash plate so that the swash plate chamber intervenes therebetween, it should be understood by those skilled in the art that the present invention can be applied to a multi-piston swash plate type compressor including a cylinder block body having cylinder bores formed at only one side thereof, which are concentrically disposed with respect to the central axis of the cylinder block body, for the purpose of positively and sufficiently lubricating the movable parts by the lubricating oil included in the refrigerant, as explained in the above-mentioned embodiments.

In addition, in the second embodiment, it is also possible to communicate the swash plate chamber with the suction chamber by using the through passage which directly opens into the corresponding suction chamber, if necessary, with the suction chambers not incommunication with the screw bores.

Finally, it will be understood by those skilled in the art that the foregoing description is of preferred embodiments of the disclosed device, and that various changes and modifications may be made to the present invention without departing from the spirit and scope thereof.

We claim:

1. A multi-piston swash plate type compressor with an internal lubricating arrangement for an air conditioning system used in a vehicle such as an automobile which comprises, in combination:

a cylinder block means in which a swash plate chamber is formed for receiving a swash plate member therein, and which has cylinder bores concentrically formed with respect to a central axis of said cylinder block means, each of said cylinder bores receiving a piston member so as to be slidably engaged with said swash plate member to reciprocate said piston member in the corresponding cylinder bore by rotation of said swash plate member, said swash plate chamber being adapted to be fed with a refrigerant including a lubrication oil from an evaporator of the air conditioning system, said swash plate member being fixedly mounted on a shaft member which extends into said swash plate chamber through an axial bore formed in said cylinder block means, and which is adapted to be connected to a prime motor of the vehicle for rotation of said swash plate, said shaft member being rotatably supported in the axial bore of said cylinder block means by thrust bearing means provided around said shaft member at the sides of said swash plate member and by radial bearing means provided within said axial bore;

housing means provided on said cylinder block means for forming a suction chamber which is communicated with said cylinder bores through the intermediary of a valve element and a discharge chamber which is communicated with said cylinder bores through the intermediary of a valve element, said suction chamber being in communication with said swash plate chamber through said axial bore of said cylinder block means, said discharge chamber being adapted to be connected to a condenser of the air conditioning system for feeding a compressed refrigerant thereto; and passage means including at least one through passage which is formed in said cylinder block means and which opens at a first end thereof into said suction chamber and at a second end thereof into said swash plate chamber in the vicinity of said thrust bearing means for feeding the refrigerent including a lubricating oil from said swash plate chamber to said suction chamber, and a groove which is radially formed on a wall surface of said cylinder block means forming said swash plate chamber and which is led into the second end of said through passage, whereby a flow of said refrigerant is guided along said groove toward the center of said swash plate chamber to positively lubricate said thrust bearing means and then introduced into the at least one through passage, said pasasge means further including a branch passage which directly branches off from said at least one through passage for introducing the refrigerant from the swash plate and to the suction chamber through said at least one through passage, said branch passage opening into said axial bore and oriented toward said radial bearing means so that a part of said refrigerant passing through said through passage is directed to said radial bearing means provided within said axial bore to positively lubricate saids radial bearing.

2. A multi-piston swash plate type compressor with an internal lubrication arrangement for an air conditioning system used in a vehicle such as an automobile, which comprises:

a cylinder block body which is assembled from a pair of cylinder block halves to form a swash plate chamber therebetween, said cylinder block halves having a same number of cylinder bores which are concentrically formed with respect to a central axis of said cylinder block body, and cylinder bores of one of said cylinder block halves being aligned and registered with cylinder bores of the other cylinder block half, respectively, with said swash plate chamber intervening therebetween;

common piston members slidably received in pairs of aligned cylinder bores, respectively;

a swash plate member which is disposed within said swash plate chamber to be slidably engaged with said common piston members so that said pistons are reciprocated in said pairs of aligned cylinder bores, respectively, by rotation of said swash plate member;

a shaft member which extends into an axial bore of said cylinder block body so that it passes through said swash plate chamber and on which said swash plate member is fixedly mounted, said shaft member being rotatably supported in the axial bore of said cylinder body by a pair of thrust bearings which are provided around said shaft member at the sides of said swash plate member and by a pair of radial bearings which are provided within said axial bore sections in said cylinder block halves, respectively;

a pair of dish-like housing members which are mounted on end faces of said cylinder block body, respectively, so as to form a suction chamber and a discharge chamber between each of said dish-like housing members and a corresponding end face of said cylinder block body;

a disc-like reed valve assembly which is disposed between each of said dish-like housing members and the corresponding end face of said cylinder block body so that each of said cylinder bores is communicated with corresponding suction and discharge chambers through the intermediary of the corresponding suction and discharge reed valve elements of said disc-like reed valve assembly; and passage means including at least one through passage which is formed in each of said cylinder block halves and which opens at a first end thereof into the corresponding suction chamber and at a second end into said swash plate chamber in the vicinity of the corresponding thrust bearings for feeding the refrigerant including a lubricating oil from from said swash plate chamber to the suction chambers, and a groove which is radially formed on each of the wall surfaces of said cylinder block halves forming said swash plate chamber and which is led into the second end of the corresponding through passage, whereby a flow of said refrigerant is guided along the groove toward the center of said swash plate chamber to positively lubricate said pair of thrust bearings and then introduced into the at least one through passage, said passage means further including a branch passage which directly branches off from said at least one through passage for introducing the refrigerant from the swash plate and to the suction chamber through said at least one through passage, said branch passage opening into the axial bore section of the corresponding cylinder block half and oriented toward said radial bearings so that a part of said refrigerent passing through said through pasage is directed to said radial bearings provided within said axial bore, whereby said pair of radial bearings is positively lubricated.

3. A multi-piston swash plate type compressor as set forth in claim 2, wherein each of said suction chambers is inwardly disposed in the corresponding dish-like housing member with respect to the discharge chamber.

4. A multi-piston swash plate type compressor as set forth in claim 2, wherein each of said suction chambers is outwardly disposed in the corresponding dish-like housing member with respect to the discharge chamber.

5. A multi-piston swash plate type compressor as set forth in claim 2, wherein each of said common piston members has a slot for receiving a peripheral portion of said swash plate member, said swash plate member being engaged with each of said piston members through the intermediary of a pair of shoe elements in such a manner that the shoe elements are slidably disposed between the opposed wall faces of said slot and the opposed side faces of said peripheral portion, respectively lubrication of said shoe elements being well improved by the fact that the flow of the refrigerant including a lubricating oil is positively guided toward the center of the swash plate chamber by said passage means.

6. A multi-piston swash plate type compressor as set forth in claim 5, wherein said shoe elements are formed as a semi-spherical element, as spherial surface thereof is in slidable contact with a complemental recess formed on the corresponding wall surface of the slot of said piston member and the other circular flat surface thereof is in slidable contact with the corresponding side face of the peripheral portion of said swash plate member.

* * * * *